United States Patent [19]

Cuschera

[11] 3,952,340

[45] Apr. 27, 1976

[54] TOILET DRAIN

[76] Inventor: Casper Cuschera, 31650 Medinah St., Hayward, Calif. 94544

[22] Filed: Nov. 25, 1974

[21] Appl. No.: 527,125

[52] U.S. Cl. ..... 4/252 R; 4/288

[51] Int. Cl.[2] ..... E03D 11/00; E03C 1/26

[58] Field of Search ..... 4/252 R, 170, 288; 285/10, 11, 31, 42, 43, 44, 56–60, 138, 158, 174, 351, 357, DIG. 11

[56] References Cited

UNITED STATES PATENTS

| | | | |
|---|---|---|---|
| 3,018,119 | 1/1962 | Champion | 285/50 |
| 3,319,268 | 5/1967 | Blumenkranz | 4/252 R |

FOREIGN PATENTS OR APPLICATIONS

| | | | |
|---|---|---|---|
| 605,526 | 3/1959 | Italy | 4/252 |

*Primary Examiner*—Richard E. Aegerter
*Assistant Examiner*—Larry Jones
*Attorney, Agent, or Firm*—Harris Zimmerman

[57] ABSTRACT

A drain for connecting a toilet to a discharge pipe includes a cylindrical drain body having a flange extending normally from the upper end thereof. The bore of the drain body is tapered at the lower end, and threaded above the tapered portion. An inwardly directed annular shoulder at the lower end of the drain body defines a lower opening which receives the discharge pipe freely therethrough. A sealing gasket disposed within the bore about the discharge pipe is bevelled at the lower end to mate with the taper of the bore. The upper end of the gasket is bevelled to mate with a correspondingly bevelled washer which is exteriorily threaded and secured within the bore. The flange includes a plurality of holes therethrough for receiving the mounting lugs depending from the toilet, and includes annular slots extending from the holes which permit securing the toilet to the drain by rotating the toilet to secure the lugs in the slots.

2 Claims, 6 Drawing Figures

TOILET DRAIN

BACKGROUND OF THE INVENTION

There are many constructions known in the prior art for joining a toilet to a discharge pipe and at the same time securing the toilet in its desired location. Generally, these involve securing the toilet to the discharge pipe with threaded fittings and sealant or the like, and bolting the toilet to the floor. Such a construction is disadvantageous in several respects. Leaks may develop in the drain connection, due to vibration of the fittings by the toilet, and due to aging of the sealing compound. Such leaks require extensive labor to be fixed, and often require the services of a highly trained plumber.

Also, the bolts which secure the toilet to the floor, although often covered by decorative fittings, are exposed to view. Too often the availability of these mounting bolts to theives and vandals results in damage, destruction or theft of the toilet. There is a paradox, then, between the difficulty in repairing such prior art constructions and their susceptibility to vandals and theives.

SUMMARY OF THE INVENTION

The present invention provides a toilet drain which is easy to install with a minimum of training, and which forms a leakproof seal with the discharge pipe. Furthermore, the present invention provides a means of securing the toilet in unobtrusive fashion to the drain itself, so that the toilet may be mounted quickly and securely in place without the possibility of unauthorized removal.

The toilet drain of the present invention includes a generally cylindrical drain body provided with an inwardly directed annular shoulder at the lower end which defines an opening through which the upper end of the discharge pipe is received. The bore of the drain body is tapered at the lower end to define an annular cavity between the bore and the discharge pipe, in which a correspondingly bevelled resilient sealing gasket is received. The upper portion of the sealing gasket is bevelled downwardly to mate with a similarly bevelled washer which is threadedly secured within the bore of the drain body. Tightening of the nut causes it to compress the gasket axially and expand it radially, sealing the discharge pipe and drain body.

The upper end of the drain body is provided with an outwardly directed flange extending perpendicularly therefrom. The flange is provided with a plurality of spaced bolt holes which facilitate bolting the drain body to the floor adjacent to the discharge pipe. The flange also includes a plurality of lug holes therethrough, from each of which extends an annularly disposed slot narrower than the lug hole. With the drain secured to the discharge pipe and bolted to the floor, the toilet is positioned superjacent the drain with lugs extending downwardly from the toilet received through the lug holes. Rotation of the toilet causes the lugs to translate into the slots and secure themselves therein, effectively securing the toilet in place with no external mounting means in evidence.

THE DRAWING

DESCRIPTION OF THE PREFERRED EMBODIMENT

Figure 2:
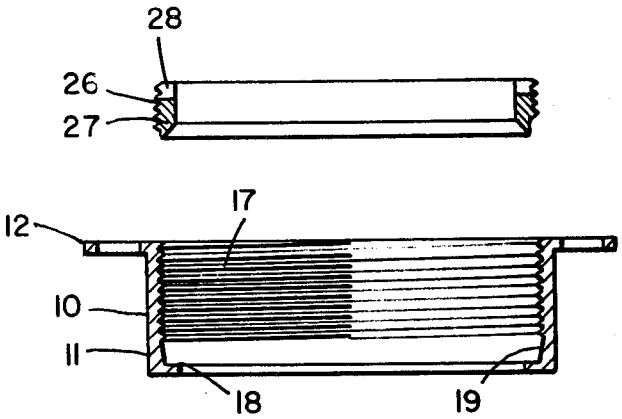
FIG. 2 is an exploded view of the components of the toilet drain of the present invention.
Figure 5:
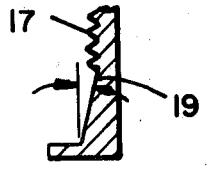
FIG. 5 is an expanded cross-sectional view of a portion of the drain body of the present invention.
Figure 3:
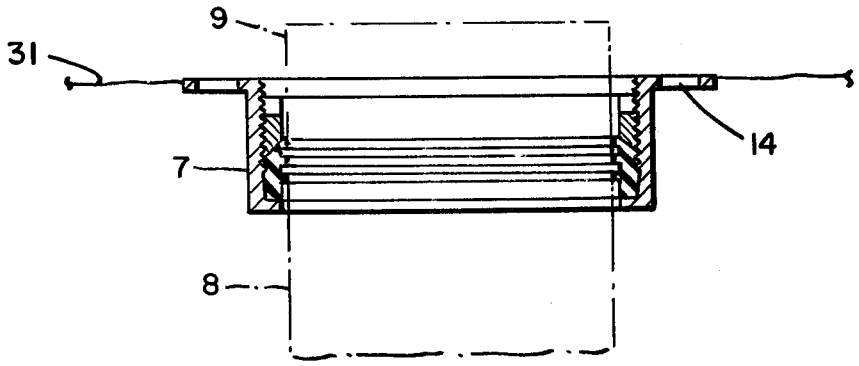
FIG. 3 is a cross-sectional elevation of the toilet drain of the present invention.
Figure 6:
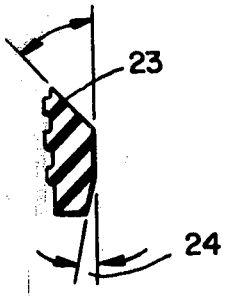
FIG. 6 is an expanded cross-sectional view of a portion of the sealing gasket of the present invention.

With reference to the accompanying Figures, and in particular FIG. 2, the preferred embodiment comprises a drain body 10 which includes a generally cylindrical member 11 having an axial bore therethrough. At the lower end of the cylindrical member 11 is disposed an inwardly directed annular shoulder 18, which defines the lower opening of the drain which is narrower in diameter than the bore. Through this lower opening extends the upper end 9 of a discharge pipe 8.

The upper end of the drain body 10 is provided with an outwardly directed flange 12 extending radially and normally from the cylindrical member 11. The flange is provided with a plurality of spaced bolt holes 13 extending vertically therethrough. The flange also includes at least two spaced lug holes 14 extending vertically therethrough, each lug hole being generally rectangular in shape. From each lug hole extends an annular slot 16 which also extends through the flange 12.

The upper and medial portions of the bore of the cylindrical member 11 are provided with internal threads 17. The lower, unthreaded portion of the bore is provided with an inwardly directed taper 19. The optimum angle of this taper is approximately 10°, for reasons which will be explained in the following. A generally sleevelike resilient sealing gasket 21 of neoprene or the like is also provided, and includes a plurality of inwardly directed annular ribs 22. The outer surface of the gasket is provided with a bevel 24 at the lower end at an angle of approximately 10°, and a bevel 23 at the upper end thereof of approximately 45° with respect to the axis of the drain.

The drain also includes an internal nut 26, which is provided with external threads 27 identical to the threads 17. The nut includes a plurality of indentations 28 in the upper surface thereof adapted to be engaged by a spanner wrench, as is well known in the art. The interior surface of the nut is provided, at the lower end, with an outwardly directed bevel 29 of approximately 45°.

The cooperative functioning of the components of the toilet drain 7 may best be described with reference to the assembly and installation of the drain. First, the drain body 10 is placed over the discharge pipe 8, with the end 9 extending therethrough. The drain body is then secured to the floor 31 by means of bolts or screws passing through holes 13 in the flange 12. The sealing gasket 21 is then placed in the annular space between the discharge pipe and the bore of the drain body. The nut is then threaded into the bore, and tightened down onto the sealing gasket. It should be noted that the bevel 24 of the gasket is identical to the taper 19 of the drain body, and and that the bevel 23 of the gasket matches the bevel 29 of the nut. As the nut is tightened the surface 29 forces the gasket both inwardly to deform the ribs 22 in sealing fashion against the discharge pipe 8, and downwardly. The downward force causes the surface 19 and 24 to interact and force the lower end of the gasket into a similar sealing deformation. The specified angular relationships provide the optimum sealing effect to prevent leaks.

It should be noted that the toilet used with the present invention is provided with a plurality of lugs subjacently extending therefrom and spaced to be received through the lug holes 14. These lugs comprise wide heads formed on short, narrow rods or the like, as is well known in the art.

Figure 1:
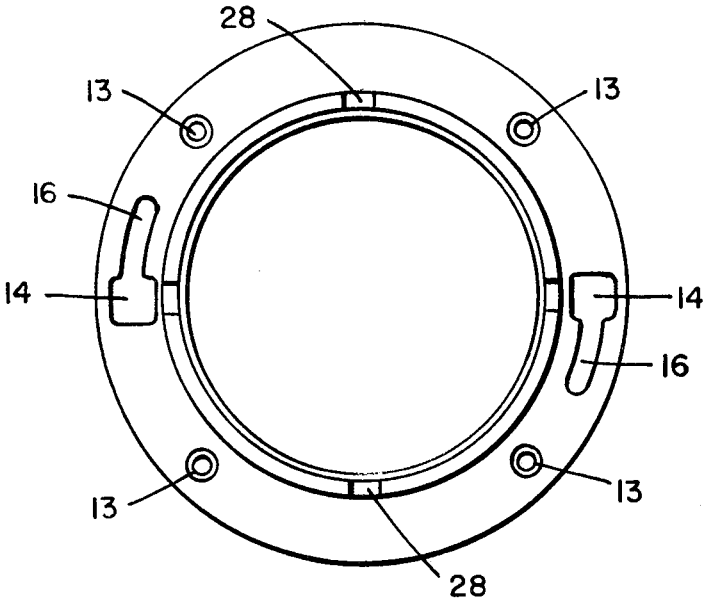
FIG. 1 is a top view of the toilet drain of the present invention.
Figure 4:
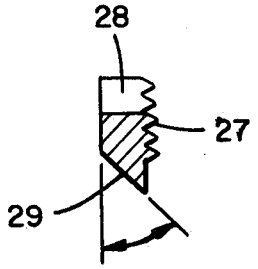
FIG. 4 is an expanded cross-sectional view of a portion of the internal nut of the present invention.

The toilet is then positioned over the drain with the lugs extending through the holes 14. The toilet is rotated clockwise with respect to FIG. 1, so that the rod portions of the lugs extend through the slots 16, and the lug heads secure the toilet to the flange. It may be appreciated that due to the fact that the flange is bolted to the floor, the toilet is also joined securely to the floor. The drain thus provides a quick and effective sealing of the toilet to the discharge pipe, while also securing the toilet in place in a manner unobvious to vandals or theives. Furthermore, the drain of the present invention is capable of being serviced quickly and easily.

I claim:

1. A toilet drain comprising a drain body having a bore extending therethrough for receiving a waste discharge pipe, said bore including an inwardly directed taper at the lower end thereof and internal threads in the upper portion thereof; a flange entending outwardly from the upper end of said drain body, said flange including first means for securing said drain body to a floor, and second means for securing said drain body to a toilet; a resilient sealing gasket disposed within said bore and about said discharge pipe, said gasket including a tapered lower exterior surface to accommodate said taper of said bore and upper surface bevelled downwardly and outwardly; and nut means for expanding said gasket radially and compressing said gasket axially, said nut means including an externally threaded nut received in said bore and including a lower surface extending obliquely downwardly to cooperatively impinge on said bevelled upper end of said gasket.

2. The toilet drain of claim 1, wherein said gasket comprises a generally sleevelike member including a plurality of inwardly directed annular ribs impinging on said discharge pipe.

* * * * *